US005315797A

United States Patent [19]

Glover et al.

[11] Patent Number: 5,315,797

[45] Date of Patent: * May 31, 1994

[54] CONVECTIVE GAS-FLOW INHIBITORS

[75] Inventors: Michael Glover; Gerhard Reichert, both of Ottawa, Canada

[73] Assignee: Lauren Manufacturing Company, New Philadelphia, Ohio

[ * ] Notice: The portion of the term of this patent subsequent to Jun. 9, 2009 has been disclaimed.

[21] Appl. No.: 791,736

[22] Filed: Oct. 15, 1991

Related U.S. Application Data

[63] Continuation-in-part of Ser. No. 515,080, Apr. 26, 1990, Pat. No. 5,119,608.

[51] Int. Cl.[5] ..... E06B 3/24

[52] U.S. Cl. ..... 52/171.3; 52/172; 52/790

[58] Field of Search ..... 52/171 R, 172, 222, 52/789, 790, 393, 203, 304; 428/34

[56] References Cited

U.S. PATENT DOCUMENTS

| | | | |
|---|---|---|---|
| 49,167 | 8/1865 | Stetson . | |
| 2,132,217 | 10/1938 | Neuendorf . | |
| 2,915,793 | 12/1959 | Berg . | |
| 3,935,681 | 2/1976 | Voiturier et al. | 52/171 |
| 3,981,111 | 9/1976 | Berthagen | 52/171 |
| 3,996,710 | 12/1976 | Nuss . | |
| 4,015,394 | 4/1977 | Kessler | 52/171 |
| 4,091,592 | 5/1978 | Berlad . | |
| 4,155,205 | 5/1979 | Polman . | |
| 4,207,869 | 6/1980 | Hart . | |
| 4,536,424 | 8/1985 | Laurent . | |
| 4,563,843 | 1/1986 | Grether . | |
| 4,791,762 | 12/1988 | Hwang . | |
| 4,831,799 | 5/1989 | Glover et al. . | |
| 4,850,175 | 7/1989 | Berdan | 52/172 |
| 5,119,608 | 6/1992 | Glover et al. | 52/171 R |
| 5,124,185 | 6/1992 | Kerr et al. | 428/34 |

FOREIGN PATENT DOCUMENTS

| | | | |
|---|---|---|---|
| 0254807 | 10/1964 | Australia | 52/172 |
| 2647337 | 4/1978 | Fed. Rep. of Germany . | |
| 2808432 | 9/1979 | Fed. Rep. of Germany . | |
| 595472 | 2/1978 | U.S.S.R. . | |
| 817526 | 7/1959 | United Kingdom . | |

*Primary Examiner*—Carl D. Friedman
*Assistant Examiner*—Wynn E. Wood
*Attorney, Agent, or Firm*—Wenderoth, Lind & Ponack

[57] ABSTRACT

There is described a multiple-pane glazing unit which has top and bottom edges and two side edges and two or more, parallel glazing sheets enclosing a vertical cavity, or cavities. A convective-flow barrier is positioned adjacent to the bottom edge of the glazing sheets within the cavity, or cavities. The barrier is a strip-like member, dimensioned to be in sealing contact, in cold temperature conditions, with both glazing sheets which form a cavity between them. The strip is of a selected material, or of a physical configuration, such that it is flexible of itself or has a flexible edge or edges to accommodate variations in cavity width caused by, say, temperature changes along the length of the barrier. A second similar convective-flow barrier may be positioned adjacent and parallel to the top edge of the unit within the cavity and indeed, intermediate barriers may also be provided between top and bottom barriers and parallel thereto. A vertically extending barrier or barriers intersecting the convective-flow barriers may also be provided.

18 Claims, 3 Drawing Sheets

CONVECTIVE GAS-FLOW INHIBITORS

This application is a continuation-in-part of our application Ser. No. 07/515,080 filed Apr. 26, 1990 now U.S. Pat. No. 5,119,608.

BACKGROUND OF THE INVENTION

1. Field of the Invention

This invention relates to sealed, multiple-pane glazing units and particularly to the solving of problems of window condensation therewith.

2. Description of the Prior Art

Conventional multiple-pane glazing units consist of two or more parallel sheets of glass which are typically spaced apart from each other using a peripheral spacing-and-sealing assembly. This peripheral assembly conventionally consists of an inner hollow metal spacer filled with desiccant-bead material and an outer hermetic-seal made from sealant material which adheres to the glazing sheets and the back face of the metal spacer. To reduce radiation heat loss, the glazing units can incorporate a low-emissivity coating which is applied to one of the glazing sheets and to further reduce conductive heat loss from the glazing, the cavity between the glazing sheets can also be filled with low-conductive gas such as argon. Conductive heat loss through the spacing-and-sealing assembly can also be reduced by replacing the conductive metal spacer with an insulating spacer.

As disclosed in U.S. Pat. No. 4,831,799 issued to Glover et al., one advantage of substituting an insulating spacer is that the cold-weather problem of edge-of-glass condensation is diminished. However, experience has shown that although the substitution of an insulating spacer substantially reduces conductive heat loss through the perimeter edge seal, condensation at the bottom edge-of-glass area can still occur particularly if there is extreme cold weather and high interior humidity levels. These cold bottom-edge temperatures are primarily caused by convective flow of the air or gas fill within the high thermal-performance, double-glazed units. Further at extreme cold temperatures, this problem of cold-bottom edge temperatures caused by convective flow within the sealed unit cavity becomes particularly significant.

In the past, various assemblies have been incorporated within the double-glazed unit and although typically these assemblies were added for mainly aesthetic reasons, these assemblies also tend to interfere with convective flow within the unit. Listed below are examples from the prior art.

U.S. Pat. No. 49,167 issued to Stetson, describes the use of wood studs which are incorporated in the sealed unit to prevent the center parts of the glazing sheets from coming in contact with each other.

U.S. Pat. No. 2,132,217 issued to Neuendorf, describes a muntin-bar grid incorporated between glazing sheets in order to give the appearance of divided lights and this mutin-bar grid creates a series of small unsealed dead-air spaces and as a result, convective flow within the sealed unit is reduced to some degree.

U.S. Pat. No. 2,915,793 issued to Berg, describes a sealed glazing unit incorporating a venetian window-blind assembly suspended between the glazing.

U.S. Pat. No. 4,091,592 issued to Berlad et al describes a window pane construction consisting of a series of closely-spaced plastic horizontal strips designed to prevent convection currents from developing in the space between the two panes. The window assembly described by Berlad is not a sealed unit and cannot be filled with a low conductive gas such as argon. Further, it should be noted that as with the other previously described additions to the air space, the horizontal film strips do not specifically address the issue of condensation along the bottom edge of the sealed unit. Also, the closely-spaced horizontal strips create visual distortions and obstruct exterior window views.

SUMMARY OF THE INVENTION

According to the present invention there is provided in a sealed, multiple-pane glazing unit having top and bottom edges and two sides and comprising at least two parallel glazing sheets enclosing at least one vertical cavity, the improvement comprising at least one convective-flow barrier positioned adjacent to the bottom edge of the glazing unit within the cavity, the barrier comprising a strip, the edges of which are in substantial sealing contact at cold temperature conditions with both glazing sheets, the strip having flexing means to provide for changes in its effective width whereby to permit the strip to accommodate variations in the width of the vertical cavity while maintaining an effective seal between the sheets, along the length of the barrier.

According to a preferred feature of the invention the strip is a horizontal strip and the barrier extends substantially parallel to the bottom edge of the glazing units.

According to a further feature of the invention the flexing means may be a flexible strip side edge on one or either side of a substantially rigid central strip body.

According to another feature of the invention the flexing means may be provided by a tensioned flexible body of the strip and the tensioned flexible body may be a flat strip of UV resistant silicone rubber, or, the tensioned flexible body may be a heat-shrinkable plastic film.

According to yet a further feature of the invention the strip may be a tubular extrusion adhered to one of the sheets, and in a preferred embodiment the tubular extrusion is a D-section profile, the flat side of which is adhered to one of the sheets.

According to another preferred feature the strip may be a U-section extrusion adhered to one of the glazing sheets.

The invention also provides, according to one preferred embodiment, a second convective-flow barrier positioned adjacent to and parallel to the top edge of the glazing unit within the cavity, the second barrier comprising a strip the edges of which are in substantial sealing contact with both glazing sheets at cold temperature conditions, the strips having flexing means to provide for changes in its effective width whereby to permit the strip to accommodate variations in the width of the vertical cavity while maintaining an effective seal between the sheets, along the length of the second barrier.

According to one aspect of the invention a further convective-flow barrier or barriers is, or are, positioned between and spaced from said first and second convective-flow barriers and located parallel thereto.

In another aspect of the invention a vertically extending barrier or barriers is, or are, provided extending parallel to the side edges and intersecting the convective flow barrier.

In a further preferred embodiment of the invention the convective-flow barriers and vertical barriers are positioned diagonally to the bottom edge and the side edges.

According to still a further feature of the invention the sealed, multiple-pane glazing unit is a triple-glazed unit and the strip is a tubular extrusion adhered to either side of a center sheet with the adhered tubular extrusions being essentially in alignment with one another.

BRIEF DESCRIPTION OF DRAWINGS

The following is a description by way of example of certain embodiments of the present invention, reference being made to the accompanying drawings, in which.

DETAILED DESCRIPTION

Figure 1:
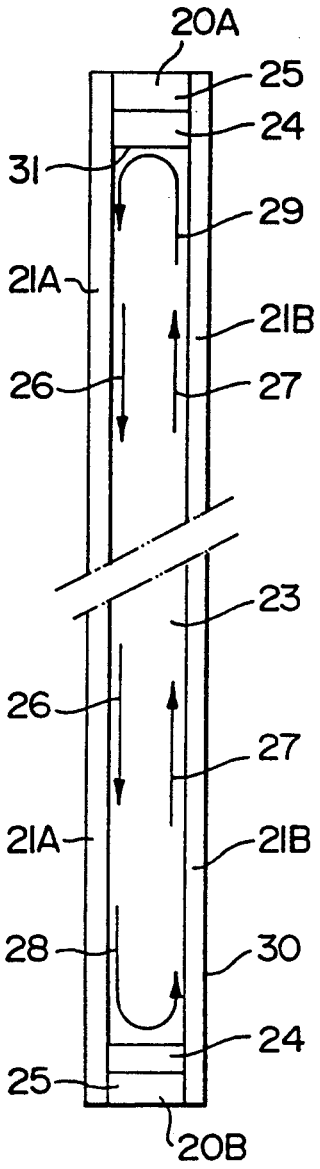
FIG. 1 is a vertical cross-section of a conventional double-glazed unit.

Referring to the drawings, FIG. 1 shows a vertical cross section of a conventional double-glazed unit. The unit consists of two parallel glazing sheets 21A and 21B separated by a peripheral spacing-and-sealing assembly 20A and 20B. A low-e coating can be applied to the inside surface of one of the glazing sheets and the vertical cavity 23 between the glazing layers can contain air or be filled with a low-conductive gas such as argon. Although various peripheral spacing-and-sealing assemblies can be used, the specific insulating edge-seal design illustrated in FIG. 1 consists of an inner desiccant-filled foam spacer 24 backed up by an outer sealant 25 and this particular spacer-and-sealing assembly 20 is described in U.S. Pat. No. 4,831,799 issued to Glover et al. The double-glazed unit is typically incorporated within a window or door frame and in operation, the glazing unit is typically installed vertically so that under cold temperature conditions, the glazing sheet 21A is on the cold side and the glazing sheet 21B is on the warm side of the window or door assembly.

It should be noted that by the term "cold-temperature conditions", it is meant a condition where there is at least a 10° C. temperature differential between the warm and cold sides of the glazing unit and these conditions are commonly experienced in cold-climate regions during the winter months.

Also, it should be noted that while the glazing units are typically incorporated in the exterior envelope of a building, the units may also be incorporated in other types of envelope assemblies where there is a 10° C. temperature differential across the glazing unit and these other envelope assemblies, include display doors for freezers and windows for transportation vehicles.

As shown in FIG. 1, under cold-temperature conditions, the air or gas fill in the double-glazed unit flows downwards near the cold exterior glazing sheet 21A, as shown by arrow 26, and upwards near the warm interior glazing sheet 21B, as shown by arrow 27. As the gas adjacent to cold exterior glazing descends, it becomes progressively colder and at the bottom of the sealed-unit cavity, this cold fill gas turns, as shown by arrow 28, and comes in direct contact with the bottom region 30 of the interior glazing sheet 21B. Consequently, the glass near the bottom edge of the interior glazing sheet is cooled by the coldest fill gas within the sealed unit and this cooling effect contributes significantly to the potential condensation problem on the bottom edge-of-glass region 30.

A similar situation occurs at the top of the cavity where the ascending warm fill gas adjacent to the interior glazing turns, as shown by arrow 29, and comes in direct contact with the top face 31 of the spacer 24. As a result, there is accentuated heat loss through the top edge seal 20A. Further, it will of course be understood that under "warm-temperature" conditions the roles of the cold side and warm side of the unit will be reversed.

Figure 2:
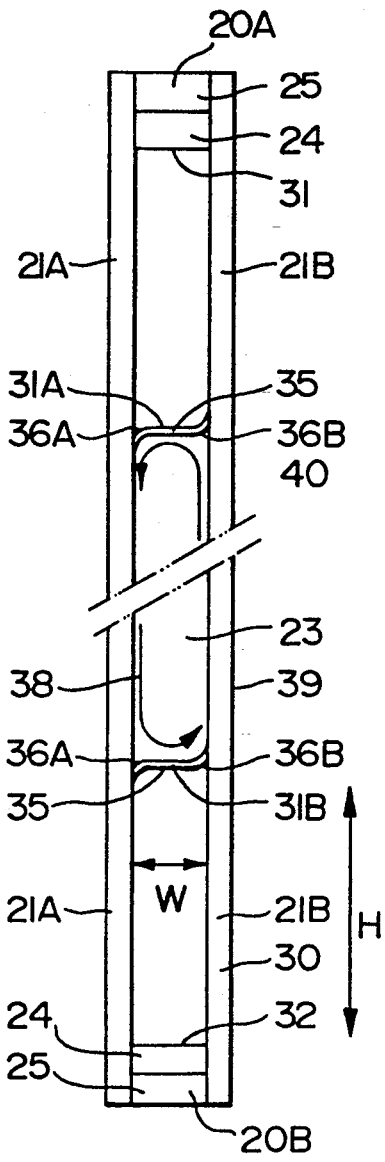
FIG. 2 is a vertical cross-section, on the line 2/2 of FIG. 4, of a conventional double-glazed unit incorporating a horizontal convective-flow barrier made from a rigid flat strip with flexible side fins.

FIG. 2 shows a vertical cross-section of a double-glazed unit of similar construction to the unit described in FIG. 1 but incorporating a horizontal convective-flow barrier 31B which is positioned parallel to the bottom edge of the double-glazed unit. The flexible edges 36A and 36B of the barrier 31B just touch the glazing sheets 21A and 21B which are spaced apart a width W. The barrier 31B is located a height H above the top face 32 of the spacer 24. Detailed experiments have shown that for optimum performance, the barrier 31B should be located at a height of about two inches above the spacer 24. As indicated by the arrow 38, the purpose of the barrier 31B is to prevent cold descending air or gas from reaching the bottom region 30 of the interior glazing sheet 21B. By blocking the cold descending air or gas fill, edge-of-glass temperatures at the bottom region 30 are increased because the cold-edge effects due to convective-flow and perimeter conductive heat loss are separated.

The specific design of a horizontal convective-flow barrier illustrated in FIG. 2 is a rigid flat strip 35 with flexible side fins 36A and 36B. The rigid flat strip 35 spans between the side edges of the sealed unit and is mechanically fixed to the perimeter spacer/glass subassembly. As explained in more detail in FIG. 3, the two flexible side edges 36A and 36B are required to achieve a continuous effective seal and prevent cold air from leaking around the convective flow barrier 31B.

At warm temperature conditions, the glass sheets 21A and 21B bow outward due to pressure build-up within the sealed unit and sealing contact between the barrier 31B and the glazing sheets 21A and 21B may not be maintained. However, at these warm temperature conditions, which typically occur during the summer months, there is no need for the convective barrier to be operational because problems with bottom edge-of-glass condensation are not typically experienced.

As well as locating a convective barrier along the bottom edge of the glazing unit, a second convective-flow barrier 31A can also be similarly located parallel to the top edge seal 20A. As indicated by arrow 40, the purpose of the top-edge convective-flow barrier 31A is to prevent the upward flow of warm gas adjacent to the interior glazing sheet 21B from directly reaching the top face of the spacer 24. By blocking the upward warm convective flow, the barrier 31A is effective in reducing heat loss because there is a lower temperature differential through the edge seal particularly at a region 31 immediately adjacent to the exterior glazing sheet 21A.

Figure 3:
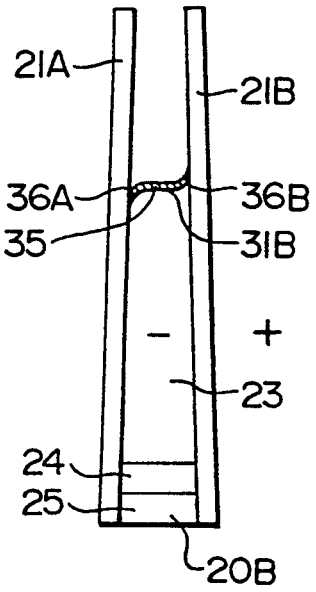
FIG. 3 is the same bottom edge cross-section as illustrated in FIG. 2 but maintained at cold temperature conditions.

FIG. 3 shows the same bottom vertical cross section as illustrated in FIG. 2 but in this case, the unit is under extreme cold-temperature conditions. Because of pressure reductions in the sealed unit at cold temperatures, the glazing sheets 21A and 21B bow inward although it should be noted that the degree of glass deflection shown in FIG. 3 is somewhat exaggerated in order to graphically illustrate the point under discussion. As the glass sheets 21A and 21B deflect inwards, the flexible side edges 36A and 36B also flex inwards ensuring that a good sealing contact is maintained along the length of the barrier 31B. It should also be noted that because the side edges 36A and 36B of the barrier are made from flexible material, the glass sheets 21A and 21B are not excessively stressed even at extreme cold temperatures when there can be significant glass bowing. Also, because the side edges are flexible, sensitive sputtered low-e coatings located on the cavity face of the glazing sheets 21A and 21B cannot be damaged when these glass sheets deflect inwards.

To ensure that the horizontal barrier illustrated in FIG. 3 is not visually obtrusive, one preferred design is to fabricate the rigid strip and side edges from transparent or translucent plastic material. Also, to avoid problems of volatile fogging, the strips are fabricated from a non-outgassing plastic material and one preferred material is an acrylic plastic. For ease of fabrication, the strip can be made as a plastic coextrusion so that the flexible edges 36A and 36B and the rigid plastic strip 35 form one integral component part.

Further, it should be noted that although the barrier 31B illustrated in FIG. 3 incorporates two flexible side edges and it is also feasible for the barrier to incorporate only a single flexible side edge 36A which to be effective must be located on the cold-side glazing sheet 21A.

Figure 4:
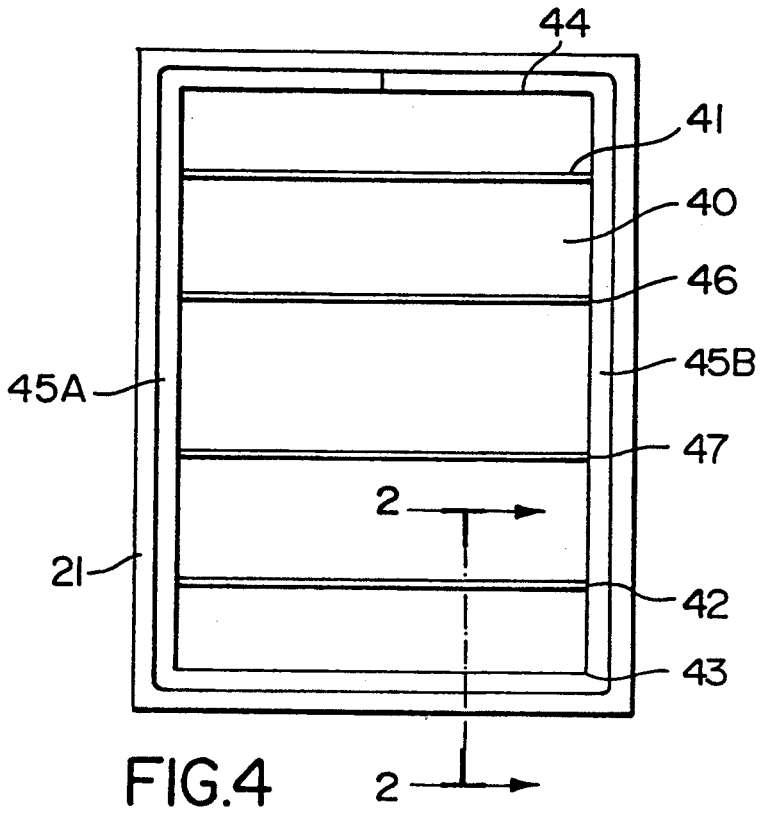
FIG. 4 is a front elevation view of a double-glazed unit incorporating multiple horizontal convective-flow barriers.

FIG. 4 shows a front elevational drawing of a sealed unit 40 incorporating both top and bottom convective-flow barriers 41 and 42 and corresponding to barriers 31A and 31B in FIG. 3. The bottom horizontal barrier 42 is parallel to and located about 2" from the bottom edge 43 of the sealed unit 40. The top horizontal barrier 41 is parallel to and located about 2" below the top edge 44 of the sealed unit 40. The two barriers span between and are mounted in any suitable way to the side edges 45A and 45B of the sealed unit 40.

To further dampen convective-flow within the sealed unit, additional horizontal convective flow barriers 46 and 47 can be installed within the sealed unit and the purpose of these additional barriers is to further block downward convective flow ensuring more even temperatures over the glazing surface area of the sealed unit 40.

The multiple horizontal convective-flow barriers shown in FIG. 4 can be fabricated in several different ways. As previously described, one preferred embodiment is to fabricate these horizontal barriers from a transparent rigid strip with flexible side edges.

Figure 5:
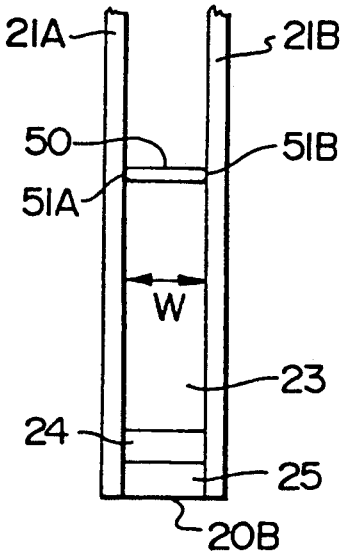
FIG. 5 is a vertical cross-section of the bottom edge of a double-glazed unit incorporating a horizontal convective-flow barrier made from a tensioned flat strip of silicone rubber material.

As illustrated in FIG.5, a second preferred embodiment is to fabricate the horizontal barrier from a tensioned strip of flexible material 50 and the preferred material is transparent or translucent silicone rubber. To maintain a straight-line, the flexible strip 50 is tensioned like a rubber band and mechanically-fixed and/or adhered to the perimeter spacer/glass subassembly on opposite sides of the sealed unit. Because it is made from UV-resistant silicone rubber, the flat strip 50 retains its elasticity and does not droop or stress relax over the extended life of the sealed unit.

As with the horizontal barrier illustrated in FIG. 2, the width of the tensioned flexible rubber strip 50 is slightly larger than the width W of the cavity space 23. As a result, under cold temperature conditions when glass sheets 21A and 21B bow inward due to pressure reductions in the sealed unit, the edges of the strip 51A and 51B also flex inward, ensuring that good sealing contact is maintained along the length of the barrier. Under warm temperature conditions because of the excellent resilient properties of silicone rubber, the tensioned rubber strip springs back to a flat horizontal position.

Figure 6:
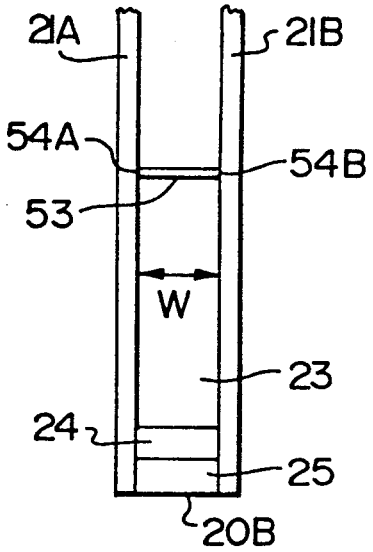
FIG. 6 is a vertical cross-section of the bottom edge of a double-glazed unit incorporating a horizontal convective-flow barrier made from plastic heat-shrinkable film material.

As illustrated in FIG. 6, a third preferred design is to fabricate the horizontal barrier from plastic transparent heat-shrinkable, flexible-film material. Using methods similar to those outlined in U.S. Pat. No. 4,335,166 issued to Lizardo et al, the flexible film strip 53 is tensioned by heat shrinking the flexible film. The width of the flexible film strip 53 is slightly larger than the width W of the cavity space 23. At cold temperature conditions, the glazing sheets 21A and 21B bow inward due to pressure reductions within the sealed unit. However, because the strip 53 is made from flexible film material, the side edges 54A and 54B of the strip 53 flex or curl inward ensuring that good sealing contact is maintained along the length of the barrier. As with the rubber strip 50 in FIG. 2 under warm temperature conditions, the tensioned film strip 53 also springs back to a flat horizontal position.

Instead of making the horizontal convective-flow barrier visually unobtrusive by fabricating it from transparent material, an alternative approach is to design the barrier as a distinctive visual feature of the window.

Figure 7:
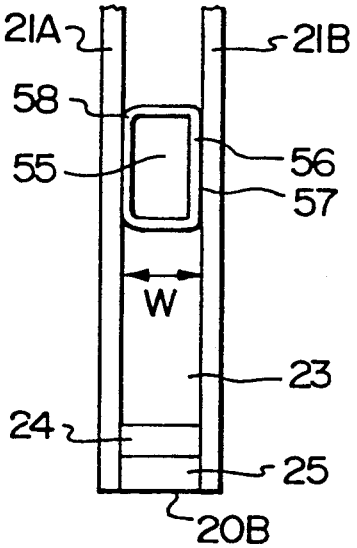
FIG. 7 is a vertical cross-section of the bottom edge of a double glazed unit, incorporating a horizontal convective-flow barrier made from a flexible tubular, D-section extrusion.

As illustrated in FIG. 7, one preferred design of this alternative approach is to fabricate the horizontal barrier from a flexible, tubular hollow-profile extrusion 55. The extrusion can be made with various cross-sectional profiles, including: circular, rectangular, and D-section profiles.

Figure 8:
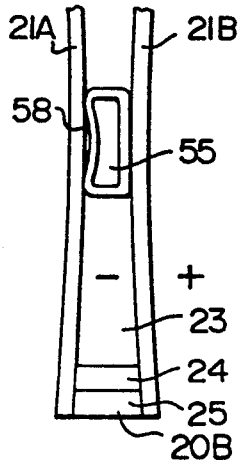
FIG. 8 is the same cross section as illustrated in FIG. 7 but maintained at cold temperature conditions.

For ease of installation, the preferred option is a D-shaped section with the flat side of the profile 56 adhered to the warm-side glass sheet 21B with a UV-resistant adhesive 57. The preferred adhesive material is a preapplied pressure sensitive acrylic adhesive. The width of the D-section profile 55 is slightly larger than the width W of the cavity space 23 and as a result as shown in FIG. 8 when the glazing sheets 21A and 21B bow inward due to pressure reductions within the sealed unit, the top part 58 of the flexible D-shaped profile 55 flattens out against the glass sheet 21A ensuring that good sealing contact is maintained along the length of the barrier strip. It should be noted that as in FIG. 3, the degree of glass deflection is somewhat exaggerated in the figure in order to graphically illustrate the point under discussion. The flexible tubular profile 55 can be fabricated from various materials and because of the need for long-term UV resistance, two preferred materials are silicone and EPDM foam.

Figure 9:
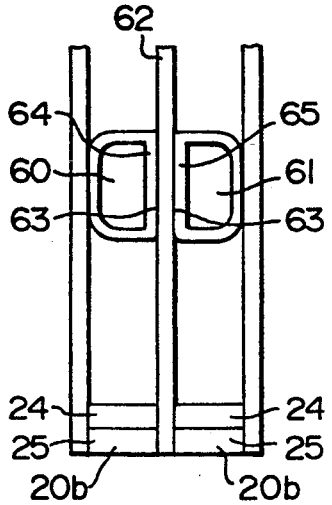
FIG. 9 is a vertical cross section of the bottom edge of a triple glazed unit incorporating two-aligned horizontal, D-section profile barriers.

As illustrated in FIG. 9, for triple glazed units, the D-section profiles 60 and 61 can be adhered to either side of the center pane 62. To create the visual appearance of a single strip, the two adhered extrusions are typically in alignment with one another and this has the advantage that the pressure-sensitive adhesive layers 63 on both flat sides 64 and 65 of the D-section profiles 60 and 61 are not directly exposed to UV-light. It should be noted that other design configurations of convective-flow barriers besides the D-section profile can be used in certain circumstances.

Figure 10:
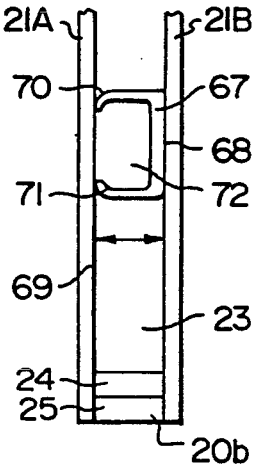
FIG. 10 is a vertical cross section of the bottom edge of a double-glazed unit incorporating a horizontal convective-flow barrier made from a flexible, U-shaped extrusion.

As illustrated in FIG. 10, a further preferred embodiment is a flexible U-section profile 67 which is adhered to the warm side glazing sheet 21B of the sealed unit with pressure sensitive adhesive 68. The width of U-channel side legs 70 and 71 is slightly larger than the width W of the sealed unit. Under cold-temperature conditions, the glass sheets 21A and 21B bow inward due to pressure reductions within the cavity space 23. However, because the side legs 70 and 71 of the U-section profile 67 are made of flexible, resilient material, the legs flex either inward or outward and ensuring that good sealing contact is maintained along the length of the barrier. Further, under warm temperature conditions, because of the resilience and flexibility of the foam material, the side legs 70 and 71 spring back to their original position. The U-shaped channel can be fabricated from various materials and because of its good memory properties, one preferred material is silicone rubber.

Compared to a hollow tubular section-profile, one advantage of the U-shaped channel profile 67 is that by inserting an appropriate hand tool within the U-channel, it is easier to apply direct pressure to fully wet out the pressure sensitive adhesive 68. A second advantage is that where a low-e coating 69 is located on the inside of the exterior glazing sheet 21B or for double low-e, triple glazing units on the inside of the exterior and interior glazing sheets, the profile does not cover up the coating 69 and as a result, the coating can function effectively reducing radiative heat loss across the enclosed air space 72.

Figure 11:
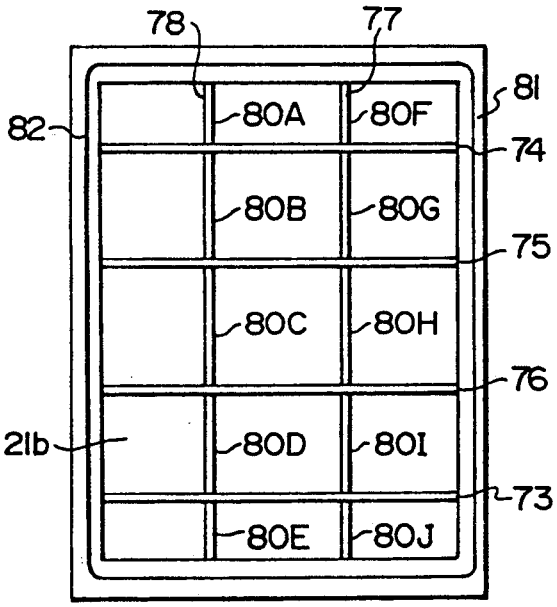
FIG. 11 is a front elevation view of a sealed unit incorporating multiple vertical and horizontal barriers.

As previously noted, hollow profile sections can be designed as decorative features of the window. As shown in FIG. 11 in order to further enhance the visual appearance of the window, the window can incorporate both multiple horizontal barriers 73, 74, 75, and 76, the bottom 73, or bottom 73 and top 74 barriers, of which are convective flow barriers as in the embodiment of FIG. 2. A central or multiple vertical barriers 77 and 78 intersect the horizontal barriers 73, 74, 75, and 76. These barriers can be arranged to create the appearance of historic divided-lite windows. The vertical barriers may be similar in cross-sectional profile to the horizontal convective-flow barriers and are directly adhered to the cavity face of the warm-side glazing sheet. Typically, the horizontal barriers are applied as a single strip while each vertical barrier is made up of a series of separate pieces 80A to 80J which are individually adhered and lined up in a straight line parallel to the side edges 81 and 82 of the glazing unit. In addition to helping create a pleasing visual effect, the vertical barriers preferably also function to dampen convective-flow within the sealed unit by further dividing up the cavity air space into a series of smaller air pockets.

Figure 12:
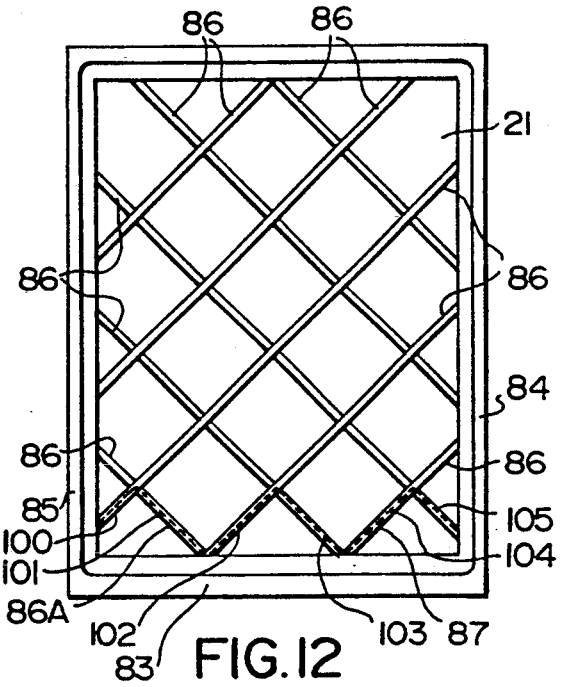
FIG. 12 is a front elevation view of a sealed unit incorporating an alternative configuration of multiple barriers.

The horizontal convective-flow and vertical barriers can be arranged in a wide variety of different patterns, and as illustrated in FIG. 12, the barriers can be arranged to create the appearance of historic leaded lites. In this case, both the "horizontal" and "vertical" strips 86 are positioned at a diagonal to bottom edge 83 and side edges 84 and 85 of the sealed unit. In this embodiment, the lower convective flow barrier is formed by elements 100–105 of the strips 86. Similarly with the upper barrier.

To demonstrate the effectiveness of the different types of horizontal convective-flow barrier designs, a series of experiments were carried out.

The test apparatus consisted of a cold chamber which could be maintained at temperatures down to −40 degrees C. The tests were performed with forced convective flow on the cold-side and natural convective airflow on the warm-side. The warm-side temperatures of the test units were measured using an Inframetrics thermographic camera and based on the infra-red images, specialized software was used to calculate and document various factors, including: surface-temperature profiles, minimum/maximum surface temperatures and average surface temperatures, etc. The infra-red thermographic camera also provided a visual multi-colored image of the warm-side surface temperatures of the test units.

Based on the cold-chamber experiments, four main conclusions were drawn.

First, the cold-chamber experiments showed that horizontal convective-flow barriers are effective in increasing bottom edge-of-glass temperatures and typically for double-glazed units temperature increases in the 3 degree to 4 degree C. range can be achieved when there is a 25° to 30° C. temperature differential between the warm and cold sides of the units.

Second, the cold-chamber experiments showed that in order for a horizontal convective-flow barrier to completely prevent cold descending air from reaching the bottom cavity edge, the barrier between the two side cavity edges has to be in continuous contact with the two glazing sheets.

Third, the cold-chamber experiments showed that although a single bottom convective-flow barrier is effective in separating the cold bottom edge-of-glass effects due to convective flow and conductive edge-seal heat loss, the overall effect is to modify surface temperatures over a larger area, and as a result compared to conventional units, condensation and misting on units with convective-flow barriers can occur over a larger glass area at very extreme, cold winter temperatures (i.e. −40 degrees C.). Further, the addition of multiple barriers can help dampen convective flow and eliminate this problem.

Fourth, the cold-chamber experiments showed that particularly for larger insulating-glass units, convective-flow can dominate and that the coldest warm-side glass temperatures can occur immediately above the horizontal convective-flow barrier rather than at the bottom edge.

What is claimed is:

1. In a sealed, multiple-pane glazing unit having top and bottom edges and two sides and comprising at least two parallel glazing sheets enclosing at least one vertical cavity, the improvement comprising at least one convective-flow barrier positioned spaced above the bottom edge of the glazing unit within the cavity and separating a minor part at the cavity lower end from the remainder of the cavity to effectively prevent gas flow therebetween, said barrier comprising a strip, the edges of which are in substantial sealing contact at cold temperature conditions with both glazing sheets, said strip having flexing means to provide for changes in its effective width whereby to permit said strip to accommodate variations in the width of said vertical cavity while maintaining an effective seal between the sheets, throughout the length of said barrier.

2. Apparatus as claimed in claim 1, wherein said strip is a horizontal strip and the barrier extends substantially parallel to the bottom edge of the glazing unit.

3. Apparatus as claimed in claim 1 in which said flexing means is a flexible strip side edge.

4. Apparatus as claimed in claim 1 in which said flexing means is a flexible strip side edge on either side of a rigid central strip body.

5. Apparatus as claimed in claim 1 in which said flexing means is provided by a tensioned flexible body of said strip.

6. Apparatus as claimed in claim 5 in which the tensioned flexible body is a flat strip of UV resistant silicone rubber.

7. Apparatus as claimed in claim 5 in which the tensioned flexible body is a heat-shrinkable plastic film.

8. Apparatus as claimed in claim 1, in which said strip is a tubular extrusion adhered to one of said sheets.

9. Apparatus as claimed in claim 8, in which said tubular extrusion is a D-section profile, the flat side of which is adhered to one of said sheets.

10. Apparatus as claimed in claim 1, where said sealed, multiple-pane glazing unit is a triple glazed unit and said strip is a tubular extrusion adhered to either side of a center pane of said triple-glazed unit and the adhered tubular extrusions being essentially in alignment with one another.

11. Apparatus as claimed in claim 1, in which said strip is a U-section extrusion adhered to one of said sheets.

12. Apparatus as claimed in claim 1, further comprising a second convective-flow barrier positioned adjacent to and parallel to the top edge of the glazing unit within the cavity, said second barrier comprising a strip the edges of which are in substantial sealing contact with both glazing sheets at cold temperature conditions said strips having flexing means to provide for changes in its effective width whereby to permit said strip to accommodate variations in the width of said vertical cavity while maintaining an effective seal between the sheets, along the length of said second barrier.

13. Apparatus as claimed in claim 12, in which a further convective-flow barrier is positioned between and spaced from said first and second convective-flow barriers and located parallel thereto.

14. Apparatus as claimed in claim 12, in which further convective-flow barriers are positioned between and spaced from said first and second convective-flow barriers and located parallel thereto.

15. Apparatus as claimed in claim 13 or 14, where a vertically extending barrier is provided extending parallel to said side edges and intersecting said convective flow barrier.

16. Apparatus as claimed in claim 15, where a plurality of vertical-extending barriers are provided.

17. Apparatus as claimed in claim 15, where said convective-flow barriers and vertical barriers are positioned diagonally to said bottom edge and said side edges.

18. Apparatus as claimed in claim 1, where said sealed multiple-pane glazing unit is a triple glazed unit and the strip is separately provided in each cavity formed by the triple glazing.

* * * * *